United States Patent [19]

Ditcher

[11] Patent Number: 4,565,347

[45] Date of Patent: Jan. 21, 1986

[54] MONOLITHIC PRECAST INVERT SYSTEM

[75] Inventor: Jack Ditcher, Langhorne, Pa.

[73] Assignee: A-Lok Products, Inc., Tullytown, Pa.

[21] Appl. No.: 515,130

[22] Filed: Jul. 19, 1983

[51] Int. Cl.[4] ..... B28B 7/30; B28B 21/88

[52] U.S. Cl. ..... 249/83; 249/11; 249/145; 249/146; 249/184

[58] Field of Search ..... 249/145, 146, 149, 177, 249/63, 85, 95, 96, 100, 10, 184, 11, 83

[56] References Cited

U.S. PATENT DOCUMENTS

| | | | |
|---|---|---|---|
| 3,758,066 | 9/1973 | Skinner et al. | 249/95 |
| 3,796,406 | 3/1974 | Ditcher | 249/11 |
| 3,815,214 | 6/1974 | Kyle, Sr. | 249/145 |
| 4,085,918 | 4/1978 | Wilkerson | 249/177 |
| 4,119,291 | 10/1978 | Polito | 249/177 |
| 4,177,229 | 12/1979 | Moore | 249/145 |
| 4,278,229 | 7/1981 | Burlett | 249/145 |
| 4,318,880 | 3/1982 | McIntosh et al. | 249/11 |
| 4,422,994 | 12/1983 | Ditcher | 264/333 |

FOREIGN PATENT DOCUMENTS

| | | | |
|---|---|---|---|
| 2498657 | 7/1982 | France | 249/10 |

*Primary Examiner*—Jay H. Woo
*Assistant Examiner*—James C. Housel
*Attorney, Agent, or Firm*—Louis Weinstein

[57] ABSTRACT

Concentric inner and outer molds define the walls of the manhole base to be cast. The top of the inner mold is provided with a stationary invert forming section and at least one swingable invert forming section swingably mounted upon a centrally located pivot pin. The invert forming mold member is provided with locating openings adapted to receive the pin within the swingable invert forming section to positively and accurately locate the swingable invert forming section. The open region between the fixed and movable sections is filled with a "knee" member in the form of a hollow curved shell which defines the central portion of the invert. The top of the inner mold may alternatively be provided with two or more swingably mounted invert forming sections.

11 Claims, 14 Drawing Figures

MONOLITHIC PRECAST INVERT SYSTEM

FIELD OF THE INVENTION

The present invention relates to manhole structures and more particularly to system and method for forming an invert in a manhole base with a single casting operation through the use of an invert forming mold section adapted to form an invert having one of a variety of angular configurations.

BACKGROUND OF THE INVENTION

Manhole structures are typically cast at the factory using the mold forms appropriate for forming each section. Manhole bases are cast using concentric inner and outer mold forms which define the walls of the manhole base. The manhole base is cast "upside down". The top member of the inner mold is typically provided with raised projections which define the invert to be formed in the manhole base. Since a variety of inverts can be formed, such as, for example, a straight-through invert, an acute angle invert, a right angle invert, and a Y-shaped invert, to name just a few possible arrangements, a separate top section is required for each invert configuration. One technique for forming a monolithic manhole base in a single pour operation, is described in copending application Ser. No. 234,639 filed Feb. 17, 1981 by this inventor, now U.S. Pat. No. 4,422,994 issued Dec. 27, 1983, and comprises a fixed invert forming section and a movable invert forming section the inner ends thereof joined by a flexible "knee" portion. However, the apparatus of the aforementioned copending application lacks means for simply and positively locating the movable invert forming section and is further incapable of forming three branched inverts, such as a Y-shaped invert. In addition, the flexible joining portion of the aformentioned copending application will form a central curvature which departs from the desired curvature.

BRIEF DESCRIPTION OF THE INVENTION

The present invention is characterized by comprising the top member for the inner mold of a manhole base casting assembly utilized to cast a manhole base, said top member having a fixed invert forming section and at least one movable invert forming section joined to an arm whose inner end is swingably mounted upon a centrally located pivot to permit the movable invert forming section (or sections) to be moved to the desired location. Positioning openings are arranged at regular angular intervals about the periphery of the top member and are adapted to receive a downwardly extending pin provided in the movable invert forming section (or sections) to simply and yet positively and accurately locate the movable forming section during casting. The central knee portion is positioned between the spaced inner ends of the fixed and movable invert forming sections and has a generally semi-cylindrical hollow configuration in order to smoothly mate with the inner ends of the fixed and movable invert forming sections to form an invert having a smooth transitional curvature moving from one invert forming section to the other. The apparatus of the present invention provides a casting system which is simple to use and which is capable of forming a wide variety of inverts reducing the number of components and hence the cost of a monolithic casting system as well as simplifying the casting operation.

OBJECTS OF THE INVENTION AND BRIEF DESCRIPTION OF THE FIGURES

It is therefore one object of the present invention to provide novel method and apparatus utilizing an invert forming member for the inner mold of a mold assembly for casting a manhole base in which the top surface of the invert forming member is provided with at least one movable invert forming section mounted to rotate about a centrally positioned pivot pin for alignment with a cooperating positioning means for simply, positively and accurately locating the movable invert forming section preparatory to casting.

Still another object of the present invention is to provide apparatus of the character described hereinabove in which curved hollow inserts are arranged between the inner ends of fixed and movable invert forming sections to fill the region therebetween and thereby provide a smooth curved transition from each invert section within the base member formed during the casting operation.

Still another object of the present invention is to provide a casting method and apparatus of the character described in which the inner mold top member may be provided with more than one movable invert forming section.

The above as well as other objects of the present invention become apparent when reading the accompanying description and drawing in which.

Figure 2:
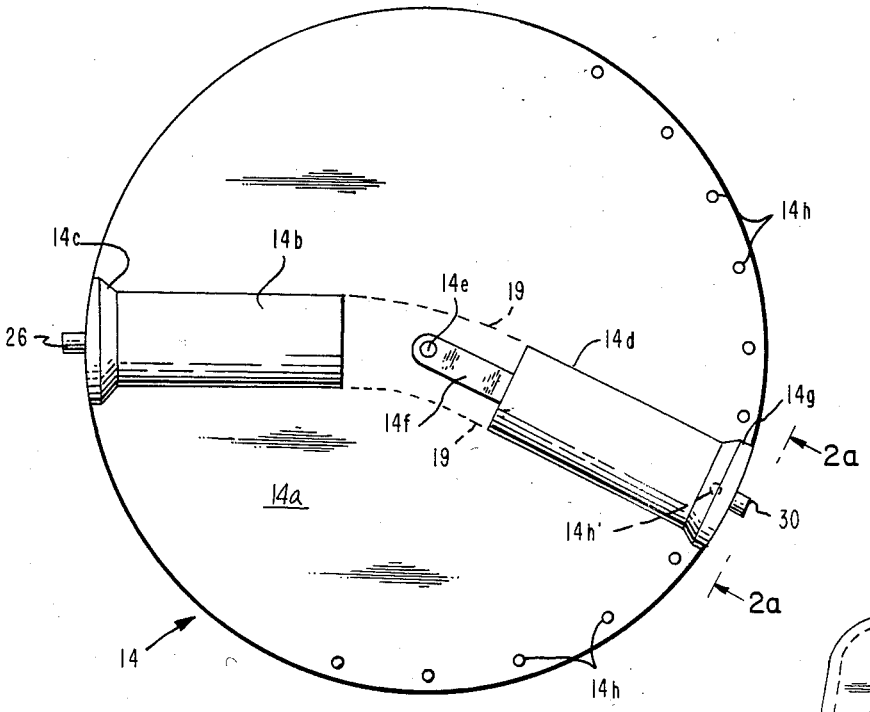
FIG. 2 is a top plan view of the inner mold employed in the system of FIG. 1.
Figure 2A:
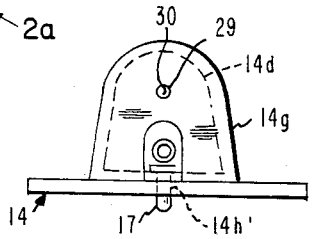

FIG. 2*a* shows an end view portion of FIG. 2 looking in the direction of arrows 2*a*—2*a*.

Figure 1:
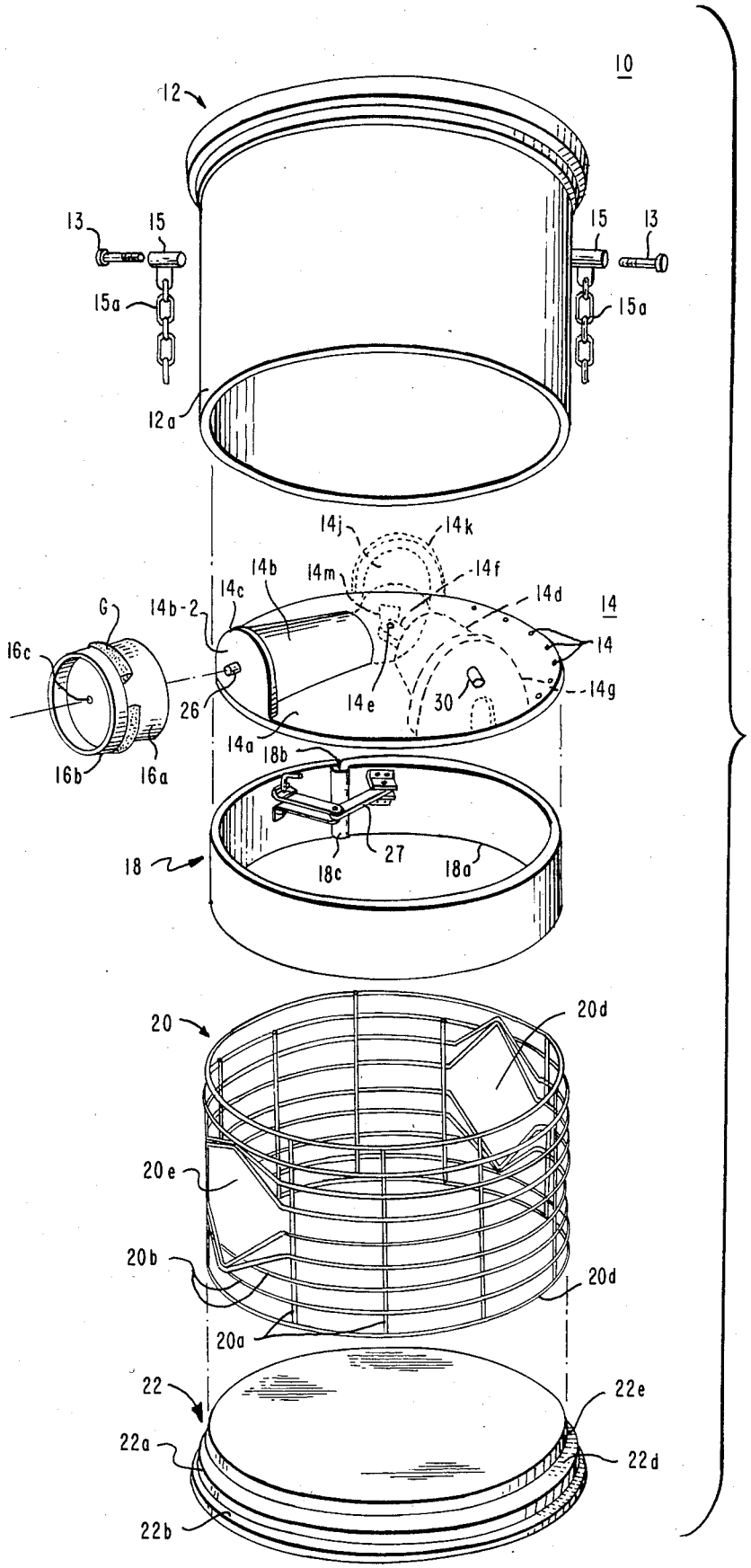
FIG. 1 shows an exploded perspective view of a monolithic casting system embodying the principles of the present invention.
Figure 3:
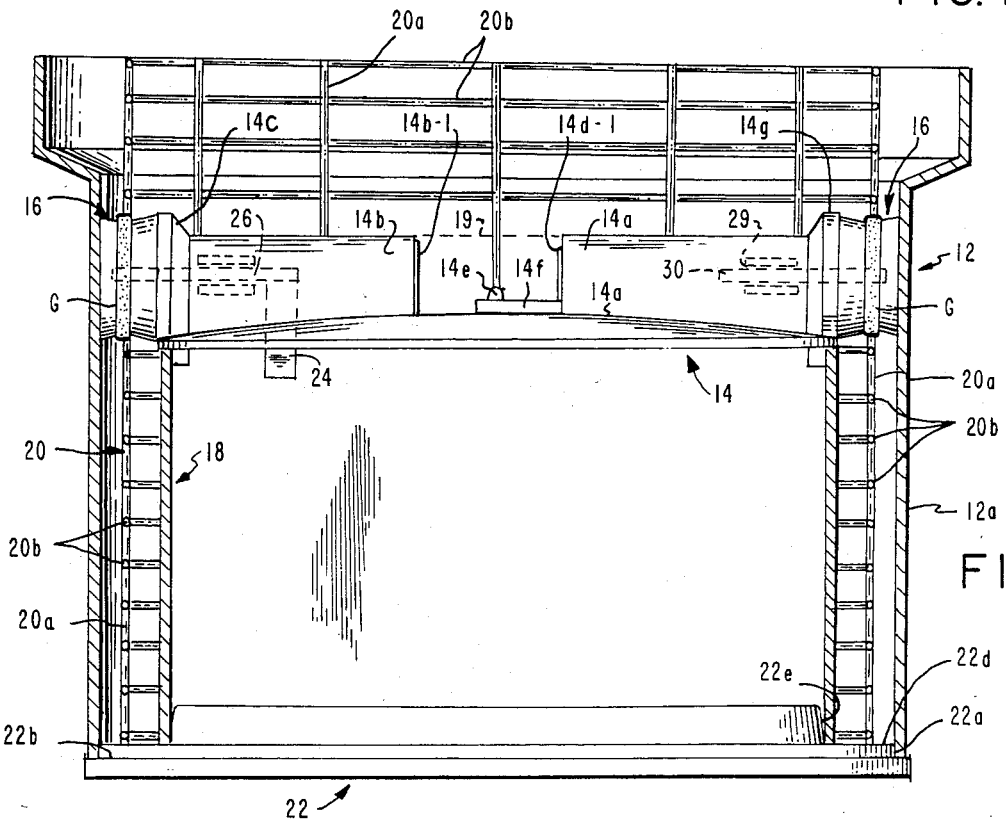

FIG. 3 shows a sectional elevational view of the assembly of FIG. 1.

Figure 4A:
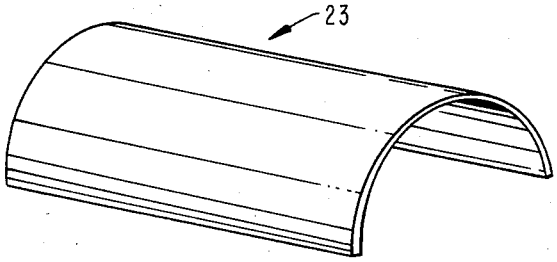
Figure 4B:
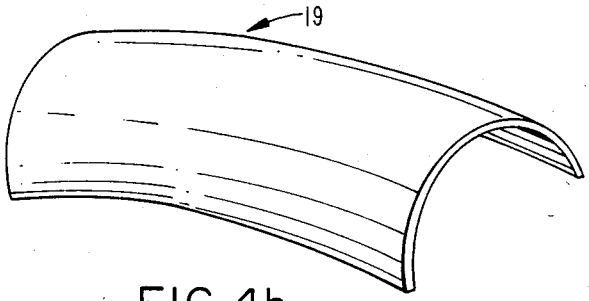
Figure 4C:
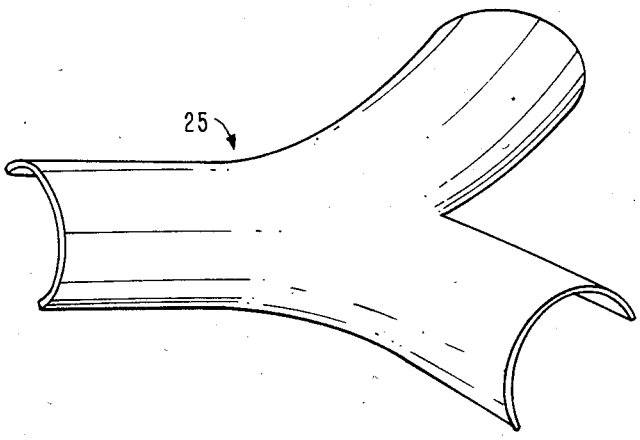

FIGS. 4*a* through 4*c* show perspective views of several center inserts selectively employed in the casting system of FIG. 1.

Figure 5:
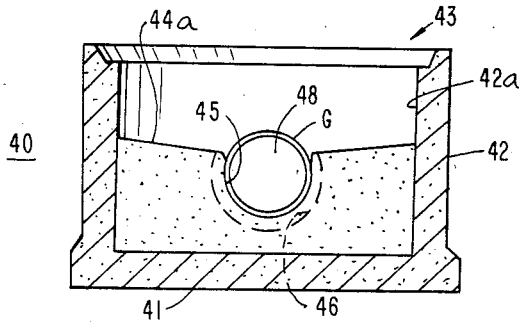

FIG. 5 shows a sectional view of a manhole base cast by using the apparatus of FIG. 1.

FIGS. 6*a* through 6*f* show top plan views of some typical invert combinations.

DETAILED DESCRIPTION OF THE INVENTION AND PREFERRED EMBODIMENTS THEREOF

FIG. 1 shows an exploded perspective view of the molding apparatus 10 employed for forming a manhole base in accordance with the single-pour technique. Apparatus 10 is comprised of a disc-shaped member 22 having an outermost vertically aligned periphery 22*a* adapted to be received within the interior of the lower edge of side wall 12*a* of the outer cylindrical mold member 12. The bottom edge 12*a* of member 12 is adapted to rest upon surface 22*b*. Member 12 defines the exterior wall of the manhole base which is cast "upside down" as will be described in detail hereinbelow. Member 12 is provided with a pair of collars 15, 15 swingably mounted to the exterior of member 12 by fastening pins 13, 13. Collars 15, 15 are each provided with a short section of chain 15*a*, 15*a* for receiving hooks (not shown) from an overhead crane, for example, for lifting and rotating the molding apparatus 10, as will be more fully described.

Cylindrical shaped inner mold member 18 is provided with a hinge assembly 27 for respectively increasing or reducing the diameter of the cylindrical inner mold member 18 for a purpose to be more fully described. Hinge assembly 19 is initially arranged to increase the diameter of the cylindrical inner hold member to properly position member 18 upon member 22, so that the cylindrical periphery 22*e* extends into the interior of inner mold member 18 and engages the inner periphery thereof, whereby lower edge 18*a* rests upon surface 22*d* of member 22.

The cylindrical-shaped wire reinforcement frame 20 is arranged between inner mold member 18 and outer mold member 12 so that its lower edge 20*d* rests upon surface 22*d* about halfway between the walls of mold members 18 and 12. Frame 20 is comprised of a plurality of vertically arranged wires 20*a* and horizontally aligned circular-shaped wire loops 20*b*, which define the wire frame 20 to form a reinforcing frame which is ultimately molded into the interior of the cast manhole base, as will be more fully described. The wire frame 20 is bent to form openings 20*c* and 20*d* for receiving the gasket retainer assemblies 16, 16.

The mold member 14 which forms and defines the invert in the manhole base is comprised of a solid main body portion 14*a* having a curved sloping surface 14*b*. Flange-like portion 14*c* is arranged at the outer end of semi-cylindrical-shaped projection 14*b* to form a recess within the interior of the manhole base, as will be more fully described, to facilitate insertion of connecting pipes. A registration pin 26 is reciprocally mounted within the body member 14*b* and is arranged to be respectively moved outwardly to mate with retaining ring assembly 16 and inwardly for release therefrom, as will be more fully described.

Mold member 14 is further comprised of a swingable semi-cylindrical shaped projecting portion 14*d* similar to projecting portion 14*b*, except that it is swingable upon member 14*a* about a pivot pin 14*e* secured to member 14*a* and pivotally mounted to the inner end of a short rod 14*f* whose outer free end is secured to projection 14*d*. The outer end of projection 14*d* is provided with a flange 14*g* substantially similar to flange 14*c* of projection 14*b*.

A plurality of openings 14*h* are arranged preferably at regularly spaced intervals about the periphery of invert forming mold member 14*a* and are designed to cooperate with a pin 17 provided within the interior of member 14*d*, and which pin is insertable into any one of the openings 14*h* in order to retain member 14*d* at the proper angular orientation relative to member 14*b*, as shown for example in FIGS. 2 and 2*a*.

Depending upon the particular configuration of the invert to be formed within the manhole base member, the outer end of member 14*d* is lifted and member 14*d* is swingable moved about pivot pin 14*e*, as shown best in FIGS. 1 and 2. When member 14*d* is moved to the appropriate angular position, member 14*d* is lowered and pin 17 is thereby dropped into the opening, such as for example the opening 14*h*' shown in FIGS. 2 and 2*a*.

After this is accomplished, a curved hollow semi-cylindrical-shaped shell 19 of the proper angular shape shown in FIGS. 2 and 4*b*, is positioned within the gap region between the inner ends of members 14*b* and 14*d* and has a curvature conforming to the angle formed between members 14*b* and 14*e*. For example, assuming it is desired to provide a straight invert, the longitudinal axes of members 14*b* and 14*d* are brought into precise alignment and the shell member 23 as shown in FIG. 4*a* is positioned to occupy the gap region between the inner ends of members 14*b* and 14*d*. Preferably, the inner ends of members 14*b* and 14*d* are provided with steps or shoulders 14*b*-1 and 14*d*-1 as shown best in FIG. 3, for positively positioning and seating the opposite ends of the semi-cylindrical shell member such as, for example, shell member 19 of FIG. 4*b* or 23 of FIG. 4*a*, depending upon the desired angle formed between the longitudinal axes of members 14*b* and 14*d*.

As shown in FIG. 1, two swingable invert portions may be provided, such as for example the swingable invert portions 14*d* and 14*j*, swingable portion 14*j* being substantially identical to swingable portion 14*d* and having a flange 14*k* substantially identical to flange 14*g*. A rod 14*m* substantially identical to rod 14*f* has its inner end mounted to swing about pin 14*e*, and has its outer end secured to invert section 14*j*.

Figure 6A:
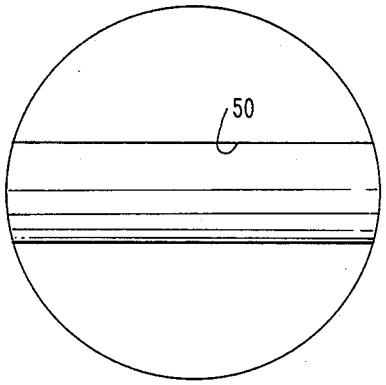
Figure 6B:
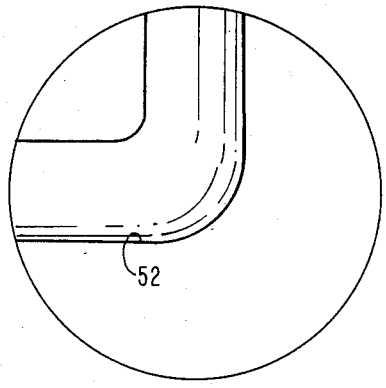
Figure 6C:
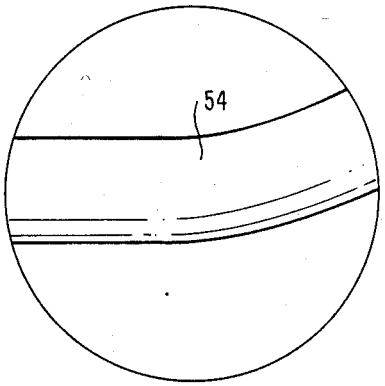
Figure 6D:
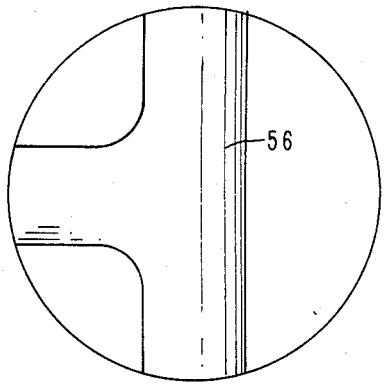
Figure 6E:
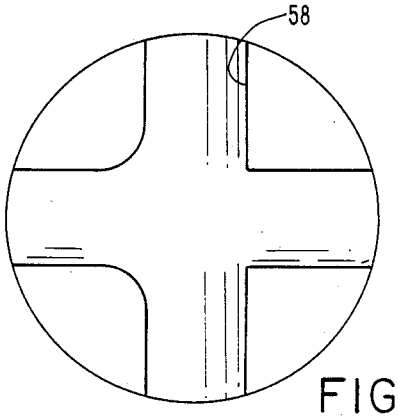
Figure 6F:
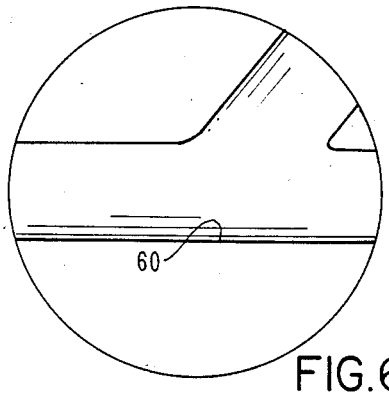

The use of two swingable invert sections permits the forming of a Y-shaped invert within the manhole base such as is shown in FIG. 6*f*. A shell member 25 usable with the stationary invert-forming section 14*b* and movable invert-forming sections 14*d* and 14*j*, is shown in FIG. 4*c*. Obviously, an entire family of such sections may be employed to accomodate for all of the different angular orientations which the sections 14*b*, 14*d* and 14*j* are capable of assuming. Of course, the practical number of such configurations is quite limited.

As was mentioned hereinabove, section 14*j* is provided with a pin similar to the pin 17 provided in swingable section 14*d*, in order to retain swingable section 14*j* at the proper orientation. Similarly, the inner end of section 14*j* is provided with a shoulder or step similar to the shoulder or step 14*b*-1 and 14*d*-1 provided in sections 14*b* and 14*d* respectively.

FIG. 3 shows the invert forming mold member 14 which is provided with an internal guideway within projection 14*b* for slidably receiving and mounting a registration pin 26. An elongated projection 24 is integrally joined to the inner end of registration pin 26 and extends downwardly through a slot provided in the underside of invert-forming member 14. Projection 24 is movable inwardly toward the center of casting assembly 10 to withdraw registration pin 26 from the gasket retaining ring assembly 16. Alternatively, member 24 is movable outwardly to move pin 26 into the central opening within the gasket retaining ring assembly 16. In order to cast a manhole base member, reinforcing frame 20 has its lower edge arranged so that it is supported upon disc-shaped member 22 and surrounds inner cylindrical mold member 18. The projection 24 is moved radially outwardly so that its associated pin 26 extends outwardly from the end surface 14*b*-2 of section 14*b*, in order to extend into the openings of the gasket retainer ring assembly 16. Gasket retainer ring assemblies 16 are described in detail in applicant's copending application Ser. No. 234,639, filed Feb. 17, 1981 and the description therein is incorporated herein by reference thereto. For purposes of understanding the present invention, it is sufficient to understand the gasket retainer assembly 16 is comprised of an inner 16*a* and outer 16*b* ring member arranged to sandwich a gasket G therebetween. The gasket G is sandwiched between the inner and outer ring members and its outwardly directed T-shaped periphery which extends radially outwardly from between the ring-shaped members 16*a*, 16*b* is adapted to be embedded and hence cast within the casting material. Releasable fastening means (not shown) are utilized to secure the inner 16*a* and outer 16*b* ring sections together during casting and are easily releasable after the cast member has set.

Each of the swingable invert-forming sections 14*d* and 14*j* are provided with an internal guideway 29 for slidably guiding a pin 30 as shown in FIG. 2*a* in order to extend the pin 30 outwardly in the manner shown in FIG. 1 to enable pin 30 to be inserted into the registration opening 16*c* provided within an associated one of the gasket retainer ring assemblies 16. The gasket retainer ring assemblies 16, 16 are mounted within the openings such as, for example, the openings 20*c* and 20*d* in wire reinforcing frame 20, as is shown in greater detail in the aformentioned copending application and the registration shafts are inserted into openings 16*c*, 16*c*. Outer cylindrical mold member rests upon base 22, thereby completing the assembly 10 of the mold members utilized to cast a manhole assembly base. The casting material is then deposited into the upper open end of the outer cylindrical mold member 12, the casting material falling by gravity so as to initially enter into the region defined by base 22*a* and the inner and outer mold members 18 and 12, to form the cylindrical side wall of the cast member. As further casting material is deposited, the casting material fills the aforementioned side wall region and begins to build upon the top surface of mold member 14. The cast material fills the mold, as shown in FIG. 3, preferably until the cast material reaches a level substantially flush with the top edge 12*c* of outer cylindrical mold member 12, whereupon the cast material is then allowed to set.

In order to reduce the time required for the casting operation, the entire casting apparatus 10 of FIG. 1 is preferably enclosed within a shroud or housing (not shown) and steam is introduced into said shroud to raise the temperature of the casting material and thereby speed up the casting operation. The casting material is preferably concrete.

The gasket mounting assemblies 16, 16 are pressed against the interior wall of outer cylindrical mold member 12 and against a portion of the outer periphery of the inner cylindrical mold member 18, in order to form and define the side wall openings in the manhole base. The outer peripheries of the gaskets are embedded within the concrete defining the openings. After the casting material has been set, the entire assembly is lifted by coupling a pair of hooks (not shown) from an overhead crane (not shown) to the chains 15*a*, 15*a*, and the entire assembly is partially lifted off the ground to a height sufficient to enable the assembly to be rotated about collars 15, 15, turning the assembly right-side up. Thereafter, the mold assembly 10 is set upon the ground, disc-shaped base member 22 is removed and the outer cylindrical mold member 12 is lifted upwardly and away from the cast manhole base. Clamping assembly 19 is manipulated to cause the marginal portions of the vertical ends 18*b* and 18*c* of mold member 18 to overlap one another in order to reduce the outer diameter of inner cylindrical mold member 18, facilitating its removal from the cast manhole base.

Thereafter, the elongated projection 24 is moved radially inwardly and registration pins provided within the invert-forming sections 14*d* and 14*j* are moved inwardly to release the gasket retaining ring assemblies from their associated registration pins in order to permit removal of invert-forming section 14 from the cast member.

Thereafter, the clamping members (not shown) holding the retaining ring halves 16*a*, 16*b* together are released, permitting the gasket retaining rings 16*a*, 16*b* to be removed from the openings within the cast member. The gasket G remains within the cast member, its outer periphery having been molded into the marginal portion of the openings within the manhole base.

FIG. 5 shows a cast manhole base 40 resulting from the casting operation employing the apparatus 10 of FIG. 1, cast manhole base 40 being comprised of base portion 41 and integral upwardly extending cylindrical-shaped side wall 42, terminating in a step-like ledge 43.

The curved upper surface of the invert-forming member 14 forms the sloping interior surfaces 44*a*, 44*b* on opposite sides of an invert 45 formed by one of the invert-forming sections 14*b* or 14*d*, sloping surfaces 44*a* and 44*b* sloping downwardly toward invert 45. Surfaces 44*a* and 44*b* cause any liquid collected thereon to run downwardly and into invert 45. The flange portion 14*c*, for example, forms and defines a semi-circular-shaped recess 46 arranged between the outer end of invert 45 and the associated side wall interior 42*a* surrounding opening 48 whose perimeter defines an opening somewhat larger than the opening defined by gasket G.

The side wall opening 48 has a taper from the interior of the opening toward the intermediate portion thereof and also has a taper from the exterior surface toward the intermediate portion of the opening 48 due to the flared shapes of the rings 16*a*, 16*b*.

Gasket G serves as a pipe-to-manhole seal. Assembly of a pipe into opening 48 is quick and easy. The free end of a pipe (not shown) is preferably coated with a suitable lubricant and is pushed into the side wall opening 48. Gasket G yields somewhat and provides a compression-type joint with no moving parts and the simplicity of the joint assembly eliminates both human error and problems inherent in rigid joints.

During casting, the gasket retaining ring assemblies 16, 16 hold the gaskets G in a shape which precisely conforms to the curvature of the openings 48. The gaskets G provide a positive watertight seal and, together with their associated recess 46, provide at least 10° omni-directional deflection of the pipe relative to the longitudinal axis of the manhole opening 48, greatly facilitating the installation and/or disassembly of a conduit system.

FIGS. 6*a* through 6*f* show a variety of different inverts which may be formed within the manhole base, FIG. 6*a* showing a straight-through invert 50, FIG. 6*b* showing a right angle shaped invert 52; FIG. 6*c* showing an invert 54 defining an acute angle; FIG. 6*d* showing an invert 56 having three sections or legs joined at right angles relative to one another; FIG. 6*e* showing an invert 58 having four sections or legs arranged at right angles to one another and FIG. 6*f* showing an invert 60 having three sections or legs joined in a substantially Y-shaped configuration. Obviously, for forming an invert 58 as shown in FIG. 6*e* having four sections, an additional invert-forming section similar to sections 14*d* and 14*j* may be arranged upon the mold member 14. These invert forming sections may be added or removed depending upon the particular invert configuration to be formed.

The shells as shown in FIGS. 4*a* through 4*c* may be molded of a suitable rugged plastic material and may be marked with indicia to indicate their particular angles.

The shells may be stored until used and require only minimum storage space. The casting apparatus thus requires only a single mold member 14 with a capability of providing a large variety of invert arrangements, some (but not all) of which are shown in FIGS. 6*a* through 6*f*.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein. For example, the invert forming mold member 14 may employ only swingable invert forming sections 14*d*, 14*j*, eliminating section 14*b*.

What is claimed is:

1. Apparatus for forming a manhole base comprising:

inner and outer mold members defining an interior volume having a cylindrical shape;

gasket retaining assemblies arranged between said mold members for retaining a gasket to be molded into the manhole base and for forming openings in said manhole base member;

an invert-forming member supported on said inner mold member and having an invert-forming surface;

said invert-forming member having a first elongated invert-forming section arranged on said invert-forming surface;

a second swingable elongated invert-forming section swingably mounted at a central point upon the invert-forming surface of said invert-forming member and having an inner end arranged a spaced distance from the adjacent end of said first invert-forming section;

hollow shell means having a substantially U-shaped cross-section and a shape conforming to the angle formed by the longitudinal axes of said first and second invert-forming sections and having an open bottom end removably positioned upon said invert-forming surface and within the gap region between the adjacent ends of said sections for filling said gap region to define a continuous invert of uniform cross-section along the length of said invert extending between the openings in said manhole base; and said invert-forming sections each having means for releasably mounting said gasket retainer assemblies thereto during the casting operation.

2. The apparatus of claim 2, wherein said swingable invert-forming section is comprised of a generally semi-cylindrical shaped invert-forming section and an elongated rod joined to the inner end of said invert forming section;

a pin secured to said invert-forming member and extending through an opening at the free end of said rod for pivotally supporting said rod and enabling said invert-forming section to be swung about said pin.

3. The apparatus of claim 1 wherein said invert-forming member is provided with a plurality of registration openings arranged at spaced intervals about an imaginary circle spaced inwardly from the periphery thereof;

said swingable invert-forming section having a pin for slidable insertion into one of said openings in order to retain the swingable member at a particular angular orientation.

4. The apparatus of claim 2 further comprising a second swingable invert-forming section swingably mounted upon the pin of said invert-forming member.

5. The apparatus of claim 4 wherein said second swingable invert-forming section is comprised of a generally semi-cylindrical shaped invert-forming section and an elongated rod having its outer end joined to the inner end of said invert forming section;

said pin being inserted through an opening at the free inner end of said rod for pivotally supporting said rod and said second invert-forming section.

6. The apparatus of claim 3 wherein the inner ends of said invert-forming sections are each provided with a step for receiving and supporting an adjacent end of said shell.

7. The apparatus of claim 1 wherein said first invert-forming section is rigidly secured to said invert-forming member.

8. The apparatus of claim 1 wherein said invert-forming sections are each provided with slidably mounted registration means extendable from the outer ends thereof for releasably mounting the gasket retainer rings in proper registration therewith.

9. The apparatus of claim 1 wherein the outer ends of said invert-forming sections are each provided with flange portions for forming substantially U-shaped recesses in the region adjacent the openings in said manhole base facilitating the insertion and manipulation of a pipe within the each manhole base opening.

10. The apparatus of claim 1 wherein said invert forming surface slopes upwardly and inwardly from the periphery thereof toward the center to form downwardly sloping surfaces in the cast member on either side of the invert.

11. The apparatus of claim 3 wherein said registration openings are arranged at regularly spaced intervals.

* * * * *